US011260442B2

(12) United States Patent
Denkmeier et al.

(10) Patent No.: US 11,260,442 B2
(45) Date of Patent: Mar. 1, 2022

(54) BENDING TOOL AND GRIPPING DEVICE FOR MANIPULATING THE BENDING TOOL

(71) Applicant: TRUMPF Maschinen Austria GmbH & Co. KG., Pasching (AT)

(72) Inventors: Thomas Denkmeier, Traun (AT); Melvin Skopljak, Wels (AT)

(73) Assignee: TRUMPF Maschinen Austria GmbH & Co. KG, Pasching (AT)

( * ) Notice: Subject to any disclaimer, the term of this patent is extended or adjusted under 35 U.S.C. 154(b) by 749 days.

(21) Appl. No.: 15/502,627

(22) PCT Filed: Aug. 11, 2015

(86) PCT No.: PCT/AT2015/050197
§ 371 (c)(1),
(2) Date: Apr. 11, 2017

(87) PCT Pub. No.: WO2016/023057
PCT Pub. Date: Feb. 18, 2016

(65) Prior Publication Data

US 2017/0232493 A1 Aug. 17, 2017

(30) Foreign Application Priority Data

Aug. 12, 2014 (AT) ..... A 50568/2014

(51) Int. Cl.
*B21D 5/02* (2006.01)
*B21D 37/14* (2006.01)

(52) U.S. Cl.
CPC ..... *B21D 5/0254* (2013.01); *B21D 5/0236* (2013.01); *B21D 5/0209* (2013.01); *B21D 37/14* (2013.01); *Y10T 483/1729* (2015.01)

(58) Field of Classification Search
CPC .. B21D 5/0203; B21D 5/0236; B21D 5/0254; B21D 37/14; B23Q 3/1556
See application file for complete search history.

(56) References Cited

U.S. PATENT DOCUMENTS 7,810,369 B2 10/2010 Rouweler et al.
2006/0277970 A1 12/2006 Pabich et al.
2016/0136706 A1* 5/2016 Mayrhofer ..... B21D 5/0236 72/481.1

FOREIGN PATENT DOCUMENTS

AT 511 591 A4 1/2013
WO 2004/024361 A1 3/2004
(Continued)

OTHER PUBLICATIONS

International Search Report of PCT/AT2015/050197, dated Nov. 30, 2015.

*Primary Examiner* — Debra M Sullivan
(74) *Attorney, Agent, or Firm* — Collard & Roe, P.C.

(57) ABSTRACT

The invention concerns a bending tool (6) with an actuating element (19) accessible outside the tool receptacle, with coupled to it a locking element (20) with a locking catch (21) for securing the bending tool (6) in the tool receptacle. The first end portion (32) of the actuating element (19) has an actuating face (33) arranged on the end side and the second end portion (34) of the actuating element (19) has an actuating recess (35).

The invention further concerns a gripping device (14) for manipulating a bending tool (6), comprising a first gripping arm (59) and a second gripping arm (60) displaceable relative to the first gripping arm (59) in the clamping direction (64), said gripping arms (59) being formed to engage in a gripping groove (23, 24) of the bending tool (6) and to clamp the bending tool (6). Also formed is an unlocking member (65) for actuating an actuating element (19) of the bending tool (6), said unlocking member (65) being longitudinally displaceable normally to the clamping direction (64) relative to the gripping arms (59, 60).

18 Claims, 15 Drawing Sheets

(56) References Cited

FOREIGN PATENT DOCUMENTS

| | | | |
|---|---|---|---|
| WO | 2004/101188 | A1 | 11/2004 |
| WO | 2007/054121 | A1 | 5/2007 |
| WO | 2013/116886 | A1 | 8/2013 |

* cited by examiner

BENDING TOOL AND GRIPPING DEVICE FOR MANIPULATING THE BENDING TOOL

CROSS REFERENCE TO RELATED APPLICATIONS

This application is the National Stage of PCT/AT2015/050197 filed on Aug. 11, 2015, which claims priority under 35 U.S.C. § 119 of Austrian Application No. A 50568/2014 filed on Aug. 12, 2014, the disclosure of which is incorporated by reference. The international application under PCT article 21(2) was not published in English.

BACKGROUND OF THE INVENTION

1. Field of the Invention

The invention relates to a bending tool for inserting into a tool receptacle and a gripping device for manipulating a bending tool.

2. The Prior Art

AT 511 591 B1 discloses a bending tool for inserting into a tool receptacle, comprising a tool body, a displaceable locking element for securing the bending tool in the tool receptacle, two actuating faces accessible from opposite sides of the tool body that are directed towards at least one actuating element that is displaceable between a base position corresponding to the locked position of the locking element and an actuating position corresponding to the unlocked position of the locking element, and where a displacement of the actuating element is translated into a movement of the locking element by means of a coupling device. The coupling device extends from the actuating element to the locking element and touches a transmission surface on the actuating element and a contact surface on the locking element, and the coupling device is further configured to be displaceable on the tool body between the actuating element and the locking element in the direction of the gap between the actuating element and the locking element.

The embodiment described in AT 511 591 B1 has the disadvantage that the design of the bending tool, especially of the locking element, consists of many component parts, making it prone to error and expensive to manufacture.

The aim of this invention is to create a bending tool and corresponding gripping device for manipulating the bending tool whose design is as simple as possible to attain high durability of the components.

This aim of the invention is achieved by a bending tool as described herein.

SUMMARY OF THE INVENTION

According to the invention, a bending tool for inserting into a tool receptacle is formed, comprising of a tool body, a locking element coupled to an actuating element that is accessible from outside the tool receptacle with a locking catch for securing the bending tool in the tool receptacle by snapping into a recess arranged in the tool receptacle. A base position of the actuating element corresponds to a locked position of the locking element and an actuating position of the actuating element corresponds to an unlocked position of the locking element. The tool body has a first and a second gripping groove that are arranged opposite to each other on the tool body, with a first end portion of the actuating element being accessible in the region of the first gripping groove and a second end portion of the actuating element being accessible in the region of the second gripping groove.

The first end portion of the actuating element has an actuating face arranged on the end side. The second end portion of the actuating element has an actuating recess.

An advantage of the invented formation is that the actuating element is coupled directly to the locking element, avoiding a complex mechanism for coupling the two elements. This means that the bending tool can be designed as simply as possible, reducing the costs of manufacturing the bending tool and increasing the functional reliability of the bending tool. Another advantage of the invented formation is that the actuating element can be actuated from two sides of the bending tool. Thus the bending tool is universally usable.

It can also be expedient for the actuating element to be rotationally symmetric in the region of the second end portion, with the actuating recess configured in the form of a circular groove. The advantage here is that the rotational symmetry allows the actuating element to be manufactured easily using a lathe tool. The circular groove has the advantage that the gripping device can grip the groove from all sides.

It can further be specified that the actuating element comprise a first actuating component at which the first end portion of the actuating element is arranged and a second actuating component at which the second end portion of the actuating element is arranged, where the first actuating component and the second actuating component are joined together such that the locking element is clamped between the two actuating components. The advantage here is that in this way a connection between the actuating element and the locking element can be produced simply, without requiring complex components.

In addition, it can be specified that the second actuating component have a screw section that is screwed into a threaded hole in the first actuating component, with the screw section then have a projection for clamping the locking element. The advantage here is that the actuating components can be built together simply, with the actuating components joined together by a detachable connection. The locking element can also easily be clamped between the two actuating components.

Also advantageous is a formation in which it can be specified that the second actuating component have a guide section that is rotationally symmetric and is received in a through-hole in the tool body. The advantage here is that the actuating component can be guided inside the tool body such that the actuating component is positioned to be displaceable inside the tool body.

In a further development, it is possible for the guide section to be arranged to connect up to the screw section, with the external diameter of the guide section being larger than the external diameter of the screw section and with a circular ring projection being arranged connecting up to the guide section. The advantage here is that this formation allows the locking element to be configured as a boundary on a first end of the guide section. The circular ring projection can serve as a boundary at the second end of the guide section. Thus the actuating element can be positioned to be displaceable inside the tool body with the displacement being limited by the ring projection and the actuating element, preventing unintended separation of the actuating element from the tool body.

It may further be expedient that the first and second gripping groove be forked and arranged parallel to each other. The advantage of a forked configuration is that the gripping device can grip the gripping groove from a parallel orientation regardless of its position. In addition, a simply designed gripping device can be used to grip the gripping groove.

It can further be specified that a centering recess that widens toward the front be arranged on the tool body in the middle of the first and the second gripping groove. The advantage here is that the centering recess can act together with a positioning protrusion on the gripping device, allowing the bending tool to be positioned in an orientation parallel to the gripping groove. A centering recess that widens towards the front in particular allows the tool body to be centred up well with the gripping device.

It can further be specified that a compression spring be arranged in a spring receptacle in the tool body that acts on the back of the locking element. The advantage here is that this way the locking element can be kept in its locked position and can only be unlocked by actuation.

The invention further provides for a gripping device for manipulating a bending tool that is part of the invention. The gripping tool comprises a first gripping arm and a second gripping arm that is displaceable relative to the first gripping arm in the clamping direction, said gripping arms being configured to engage in a gripping groove in the bending tool and to clamp the bending tool, characterized by the fact that an unlocking member for actuating an actuating element of the bending tool is further provided, said unlocking member being longitudinally displaceable normally to the clamping direction relative to the gripping arms. The advantage here is that such a gripping device can be used to insert the bending tool into a tool receptacle and therefore protect it against falling out. Through the unlocking member, the bending tool can be secured against falling out of the tool receptacle at any time by the gripping arm and the bending tool can easily be fixed in the tool receptacle.

In a special formation, it is possible for the unlocking member to be mounted on the second gripping arm by a non-turning longitudinal guide, through which the unlocking member is positioned longitudinally displaceably on the second gripping arm, in particular by at least two guide bolts that act together with a slot on the unlocking member. The advantage here is that the non-turning longitudinal guide positions the unlocking member displaceably on the second gripping arm, allowing it to be controlled by an actuator. A design using two guide bolts that engage in a slot can in particular be implemented simply and cost-effectively in this way.

In an advantageous further development, it can be specified that both the first gripping arm and the second gripping arm each have a recess in the center of a gripping section, with two gripping fingers arranged on each gripping arm through said recess, with the unlocking member being moveable within the recesses. The bending tool in the invention in particular is adapted to the design of this gripping arm and can be held well by the gripping arm.

It can be especially advantageous if a centering protrusion is arranged in the gripping section of the first gripping arm that acts together with a centering recess in the bending tool. This makes it possible to position the bending tool well relative to the gripping arm so that it can be held securely.

It can further be expedient for a wear protection element to be arranged at the front end portion of the first gripping arm, with a wearing face of the wear protection element being oriented parallel to the clamping direction. The advantage here is that the gripping device can be moved to the bending tool with a touch in order to achieve correct positioning of the gripping device relative to the bending tool and in order to position the bending tool well in this way.

It can further be specified that the second gripping arm be displaceable relative to the first gripping arm via a first actuator. The advantage here is that the gripping movement can be executed independently of the main movements of a robot arm to which the gripping device is attached.

In addition, it can be specified that the unlocking member be longitudinally displaceable via a second actuator. The advantage here is that through the unlocking member, which is controlled by an actuator and is therefore freely moveable at all times, the bending tool can be secured by the gripping arm against falling out of the tool receptacle at any time. In addition, the bending tool can easily be fixed inside the tool receptacle in this way.

Also advantageous is a formation in which it can be specified that the unlocking member have a gripping catch for engaging in an actuating recess of the actuating element of the bending tool. The advantage here is that the gripping device can not only unlock the unlocking member by pressing on it, but that the unlocking member can also be activated by a pulling motion. Thus the gripping device can receive the bending tool and also activate the unlocking member from both sides in order to separate the bending tool from the tool receptacle.

Finally, it can be specified that the unlocking member have a manipulation face for adjusting an actuating face of the actuating element of the bending tool. The advantage here is that the manipulation face can act as the touch for activating the actuating element.

BRIEF DESCRIPTION OF THE DRAWINGS

To facilitate better understanding of the invention, it will be explained in detail using the figures below.

Extremely simplified, schematic depictions show the following:

FIG. 5 A top view of the bending tool;

DETAILED DESCRIPTION OF THE PREFERRED EMBODIMENTS

In introduction, let it be noted that in the variously described embodiments, identical parts are provided with identical reference signs or identical component names, and that the disclosures contained in the description as a whole can be carried over analogously to identical parts with identical reference signs or identical component names. Likewise, positional information selected in the description, e.g. above, below, on the side, etc. refer to the directly described and depicted figure and if the position is changed, this positional information carries over analogously to the new position.

Figure 1:
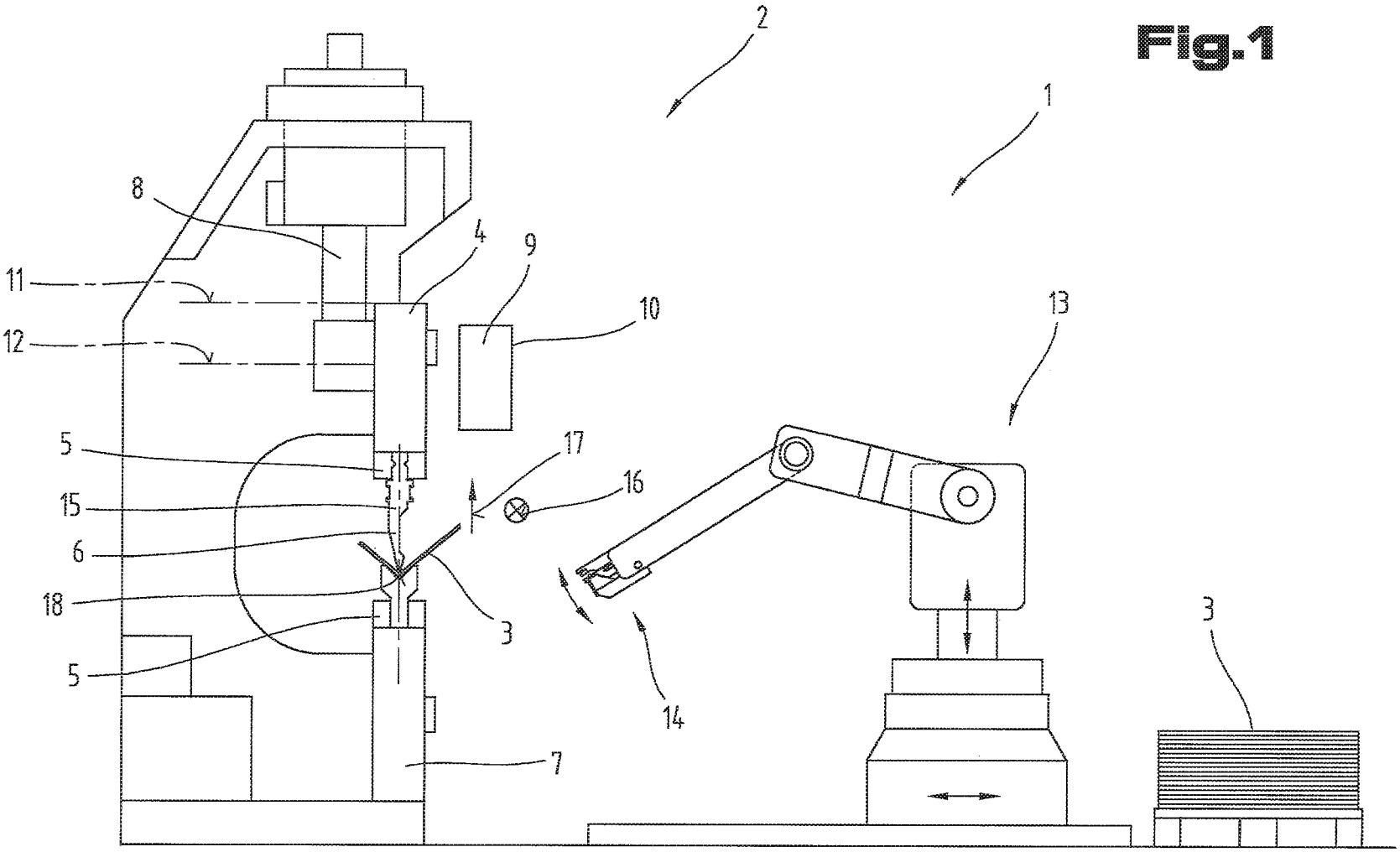
FIG. 1 A side view of a schematically depicted processing system.

FIG. 1 shows a schematic depiction of the side view of a processing system 1. The processing system 1 comprises a bending press 2 intended for bending of a sheet of metal 3.

The bending press 2 comprises a first displaceable pressing beam 4 in which a tool receptacle 5 is formed for receiving a first bending tool 6. The bending press 2 further comprises a second fixed pressing beam 7 in which is also formed a tool receptacle 5 for receiving a bending tool 6.

The sheet 3 to be bent is inserted between the bending tools 6 of the first 4 and the second pressing beam 7 for the bending process. The bending tool 6 fixed in the first pressing beam 4 or the first displaceable pressing beam 4 is moved by a press drive unit 8 in the vertical direction upwards or downwards. A computer unit 9 is provided to control the press drive unit 8 and can be coupled to an input and/or display unit 10. The first pressing beam 4 can displaced between an upper end position 11 and a lower end position 12 by the press drive unit 8.

It can further be specified that the processing system 1 include a manipulation device 13 that can automatically manipulate the sheets 3 to be processed. Alternately, it can also be specified that the sheets 3 to be processed be inserted into the bending press 2 manually.

As depicted in FIG. 1, it can further be specified that the processing system 1 include a gripping device 14. As visible in FIG. 1, it can be specified that the gripping device 14 be held/moved by the manipulation device 13. Instead of using a manipulation device 13 to hold the gripping device 14 as shown in FIG. 1, it can also be specified that, for example, a rear touch unit, not shown, be arranged to be able to manipulate the gripping device 14 or change tools.

It is further visible from FIG. 1 that the bending tool 6 has a tool body 15 that reshapes the sheet 3 being bent in the bending process. The bending tool 6 can be positioned in the tool receptacle 5 in the horizontal displacement direction 16 along the clamping section of the tool receptacle 5. For this, the bending tool 6 must be inserted in the horizontal displacement direction 16 sideways into the tool receptacle 5 of the pressing beam 4.

Alternately, it is also possible for the bending tool 6 to be inserted into the tool receptacle 5 in the vertical insertion direction 17. For this option for placement of the bending tool 6 into the tool receptacle 5, it is necessary for the bending tool 6 to be formed as specified by the invention and as described in more detail in the other figures. The elements described below allow insertion of the bending tool 6 in the vertical insertion direction 17 without any problem. It is possible to manipulate and grip the bending tool 6 appropriately in particular in conjunction with the invented gripping device 14.

Multiple bending tools 6 that are formed similarly can be positioned in the tool receptacle 5 and linked together, allowing bending edges 18 of individual bending tools 6 to form one corresponding long processing edge. Another possibility is to position multiple different bending tools 6 in the tool receptacle 5. These different bending tools 6 are then used for different bending processes and can be swapped out individually. If bending tools 6 of different types are used for different work steps, then it is usual for these to be arranged at a certain distance from each other. To provide as flexible a processing system 1 as possible, it is necessary for the bending tools 6 to be braced in the tool receptacle 5 and removed from it again quickly and easily.

FIGS. 2 to 5 depict an example embodiment of a bending tool 6 according to the invention in various views, with identical reference signs and component names being used for the same parts as in the preceding figures. To avoid unnecessary repetition, please refer to the detailed description in the above figures.

Figure 2:
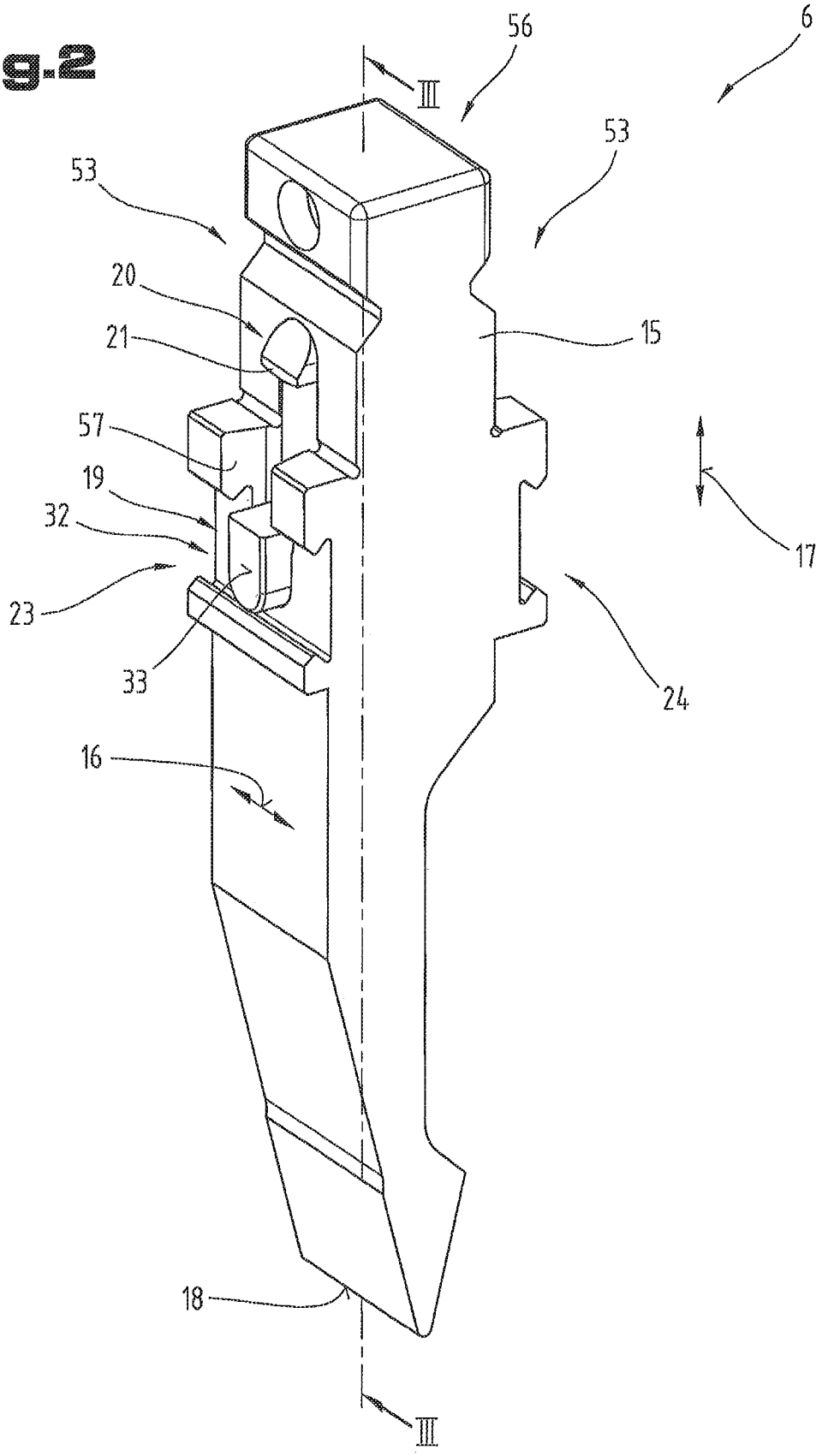
FIG. 2 A perspective view of a bending tool.

FIG. 2 depicts the bending tool 6 in a perspective view. It is easily visible here that the main component of the bending tool 6 is the tool body 15. The tool body contains an actuating element 19 that is coupled to a locking element 20. The purpose of the locking element 20 is to be able to insert the bending tool 6 into the tool receptacle 5 in a vertical insertion direction 17 and to hold it secure in the tool receptacle 5 until the bending tool 6 can be clamped by the tool receptacle 5. However, this is only possible if all bending tools 6 needed for a particular bending process are mounted in the tool receptacle 5.

The locking element 20 has a locking catch 21 that can be moved out if necessary, protruding compared to the tool body 15, by shifting the locking element 20 and can therefore engage in a corresponding recess 22 in the tool receptacle 5 in order to secure the bending tool 6 in the vertical insertion direction 17. It is further also possible to shift the locking element 20 in the tool body 15 in such a way that the locking catch 21 does not engage in the recess 22 in the tool receptacle 5 and thus that the bending tool 6 is freed from the tool receptacle 5 to move in the vertical insertion direction 17.

It is further visible from FIG. 2 that the tool body 15 has a first gripping groove 23 and a second gripping groove 24 that are formed in the tool body 15. The gripping grooves 23, 24 are arranged opposite to each other on the tool body 15, extending in a longitudinal direction parallel to the bending edge 18. The gripping grooves 23, 24 have such a form that the gripping device 14 can engage in them when changing the bending tool and can thereby mount and, when necessary, dismount the bending tool 6 on and from the bending press 2.

However, it is not mandatory for the gripping grooves 23, 24 to take the form of a groove, but is conceivable that they might, for example, take the form of simple drilled holes into which a gripping device 14 can engage.

Figure 3:
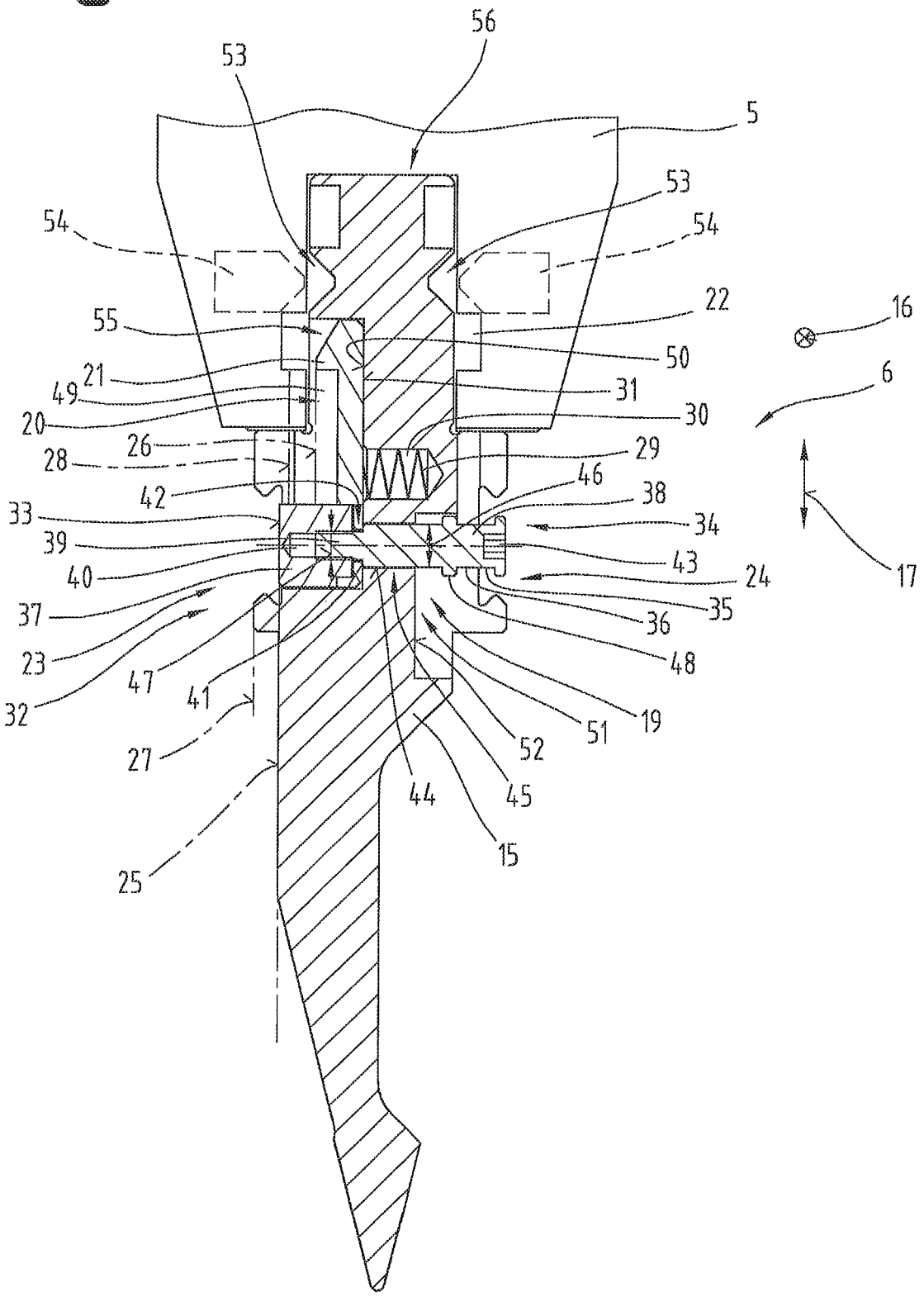
FIG. 3 A cross-sectional view of the bending tool according to cross-section III-III as per FIG. 2, with the actuating element in the actuating position.
Figure 4:
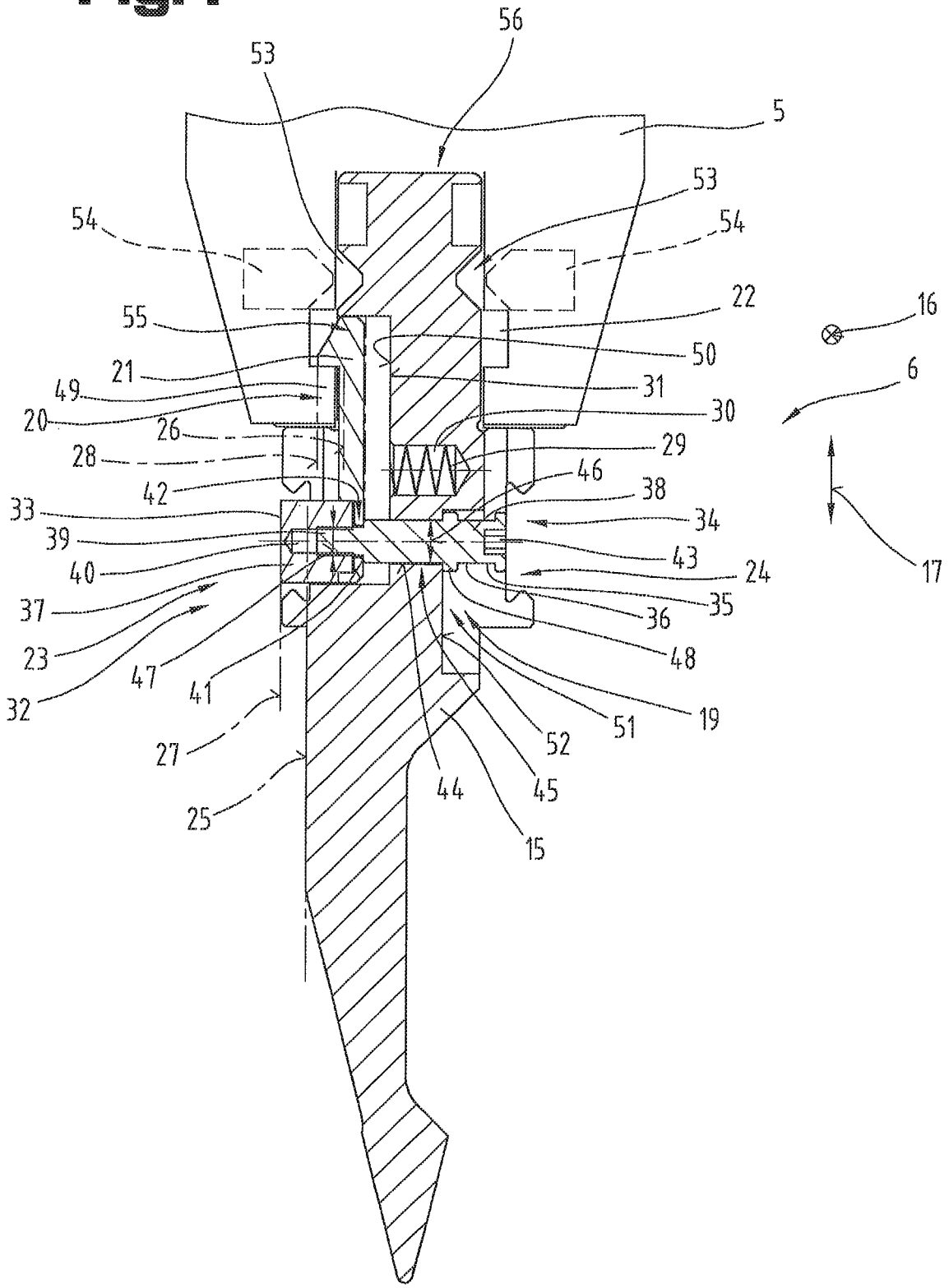
FIG. 4 A cross-sectional view of the bending tool according to cross-section III-III as per FIG. 2, with the actuating element in the base position.

FIGS. 3 and 4 show the bending tool 6 in a cross-sectional view according to cross-section III-III as per FIG. 2.

In the view in FIG. 3, the actuating element 19 is in the actuating position in which it is pressed in/activated. In connection with this, the locking element 20 is in the unlocked position 26, in which the locking catch 21 does not engage in the recess 22 in the tool receptacle 5 and the bending tool 6 can therefore be moved in or out of the tool receptacle 5 in the vertical insertion direction 17.

In the additional depiction in FIG. 4, the actuating element 19 is in a base position 27 in which it is not pressed in/activated. Corresponding to this, the locking element 20 is in a locked position 28. Here the locking catch 21 is in the recess 22 of the tool receptacle 5 such that there is a positive connection between these two elements. Thus the bending tool 6 cannot be moved out of the tool receptacle 5 in the vertical insertion direction 17 and is secured against falling out. The locking element 20 is held in its locked position 28 by a compression spring 29. The compression spring 29 is arranged in a spring receptacle 30 in the tool body 15. The spring receptacle 30 can take the form of a simple drilled hole placed such that the spring 29 presses on a back side 32 of the locking element 20. In other words, without any intervening external force the locking element 20 is in its locked position 28 and thus secures the bending tool 6 against falling out. To move the locking element 20 out of its locked position 28 into the unlocked position 26, it is necessary to move the locking element 20 using the actuating element 19 coupled to it. Here it is necessary for the actuating element 19 to have a first end portion 32 in the region of the first gripping groove 23 where an actuating face 33 is arranged in order to be actuated by a gripping device 14. The gripping device 14 can press on the actuating face 33 and thus press the actuating element 19 out of its base position 27 into its actuating position 25. It is further specified that the actuating element 19 have a second end portion 34 in the region of the second gripping groove 24 in which an actuating recess 35 is arranged. The gripping device 14 can engage in the actuating recess 35 and pull the actuating element 19 out, in this way also moving the actuating element 19 out of its base position 27 into the actuating position 25. Thus it can be achieved that the bending tool 6 can be taken up by the gripping device 14 as desired either at the first gripping groove 23 or at the second gripping groove 24.

As is visible from viewing FIG. 3 and FIG. 4 together, it can be specified that the actuating recess 35 be executed in the form of a circular groove 36 into which the gripping device 14 can engage. In a preferred embodiment depicted here, it can be specified that the actuating element 19 be executed in two parts, with a first actuating component 37 and a second actuating component 38 being formed between which the locking element 20 is placed and which actuating components 37, 38 are connected to each other. It can be specified here that the first actuating component 37 have the first end portion 32 and thus that the actuating face 33 be arranged on it. It can further be specified that the second actuating component 38 have the second end portion 34 and thus that the actuating recess 35 be arranged on it.

In order to join and/or attach the two actuating components 37, 38 to each other, it can be specified that the second actuating component 38 have a screw section 39 that acts together with a threaded hole 40 of the first actuating component 37. It can further be specified that a projection 41 be placed at the end of the screw section 39 by means of which the locking element 20 can be clamped between the first actuating component 37 and the second actuating component 38. In particular, it can be specified here that locking element 20 have a through-hole through which the screw section 39 of the second actuating component 38 extends, allowing the locking element 20 to be received between the two actuating components 37, 38.

In order to screw the second actuating component 38 into the first actuating component 37, it can be specified that a hexagon socket 43 be arranged in the second end portion 34 of the actuating element 19, into which a hexagon socket key can engage in order to turn the second actuating component 38 relative to the first actuating component 37.

It can further be specified that the second actuating component 38 have a guide section 44 after the screw section 39, also designed to be rotationally symmetric. It can be specified here that a through-hole 45 be provided in the tool body 15 that extends from the first gripping groove 23 to the second gripping groove 24 and into which the actuating element 19 is received. In particular, it can be specified that the guide section 44 be received in the through-hole 45 and thus that the actuating element 19 be moveable back and forth between base position 27 and actuating position 25. A loose fit is preferred between the guide section 44 and the through-hole so that the actuating element 19 can be shifted easily. It can further be specified that a sleeve bearing socket or other material with good sliding properties be integrated into the through-hole 45 or the guide section 44 in order to allow easy movement of the actuating element 19.

To obtain the projection 41 for clamping the locking element 20 on the actuating element 19, it is necessary for an external diameter 46 of the guide section 44 to be chosen to be greater than an external diameter 47 of the screw section 39. It can further be specified that a ring projection 48 be arranged at the end of the guide section 44 on the second actuating component 38 to limit the displacement of the actuating element 19.

As is visible from FIGS. 3 and 4, it can be specified that a locking element receptacle 49 be provided in the tool body 15 that could have the external form of the locking element 20. This way the locking element 20 can be received in the tool body 15. The ability to be displaced of the actuating element 19 and, related to this, of the locking element 20 is limited on the one side by the fact that the locking element 20, especially its back side 31, abuts against a bottom face 50 of the locking element receptacle 49. This is the case when the actuating element 19 is activated by the gripping device 14 and is thus in its actuating position 25. On the other side, the ability to be displaced of the actuating element 19 is limited by the fact that the actuating element 19, especially the ring projection 48, abuts against an actuating element receptacle 51, more precisely against its bottom face 52.

The locking element receptacle 49 is arranged in the region of the first gripping groove 23. The actuating element receptacle 51 is arranged in the region of the second gripping groove 24. The spring receptacle 30 is arranged directly on the bottom face 50 of the locking element receptacle 49.

It can further be specified that at least one clamping recess 53 be arranged in the tool body 15 in which clamping jaws 54 of the tool receptacle 5 can engage and the bending tool 6 can thus be fixed in the tool receptacle 5.

It can further be specified that the locking element 20, especially on its locking catch 21, have a bevel 55 that is slanted in the direction of the receptacle section 56 of the bending tool 6. This makes it possible to insert the bending tool 6 into the tool receptacle 5 in the vertical insertion direction 17 from below without the actuating element 19 having to be actuated by the gripping device 14, as the bevel 55 and, correspondingly, the tool receptacle 5 press the locking element 20 out of its locked position 28 into its unlocked position 26.

FIG. 5 depicts a top view of the bending tool, showing when seen together with FIG. 2 that a centering recess 57 is formed in the tool body 15 both in the region of the first gripping groove 23 and in the region of the second gripping groove 24, making reception of the bending tool 6 by the gripping device 14 easier. In particular, the centering recess 57 makes correct positioning of the bending tool 6 relative to the gripping device 14 easier. As is visible from FIG. 5, it can be provided here that the centering recesses 57 are arranged in the middle of a symmetrical axis 58 of the bending tool 6.

Figure 7:
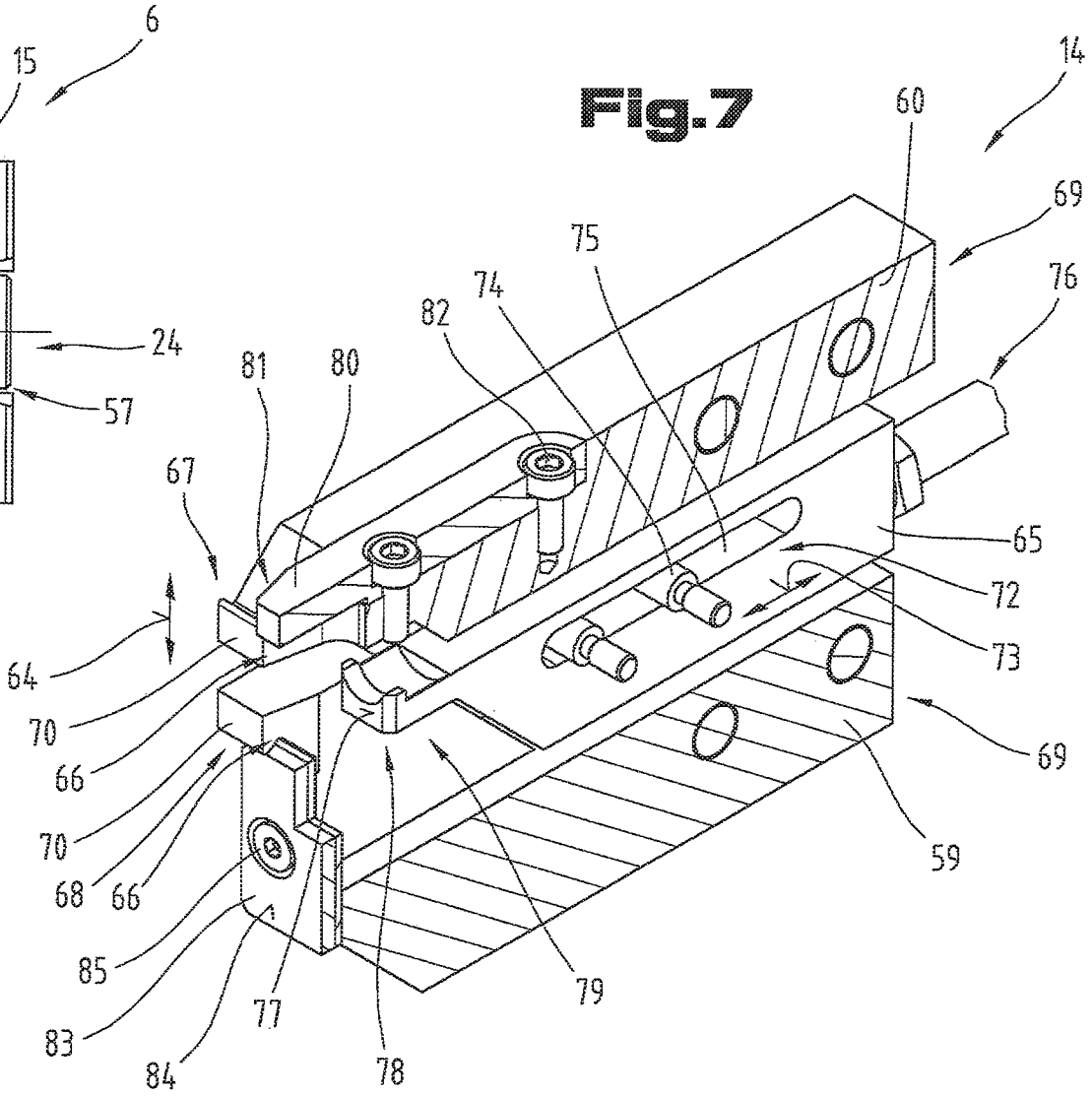
FIG. 7 A perspective view of the gripping device in half-section.
Figure 6:
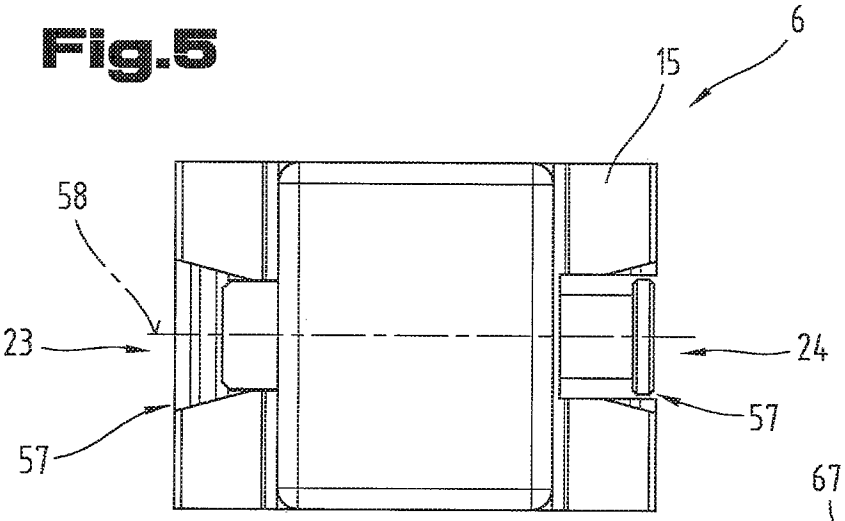
FIG. 6 A perspective view of a gripping device for manipulating the bending tool.
Figure 6:
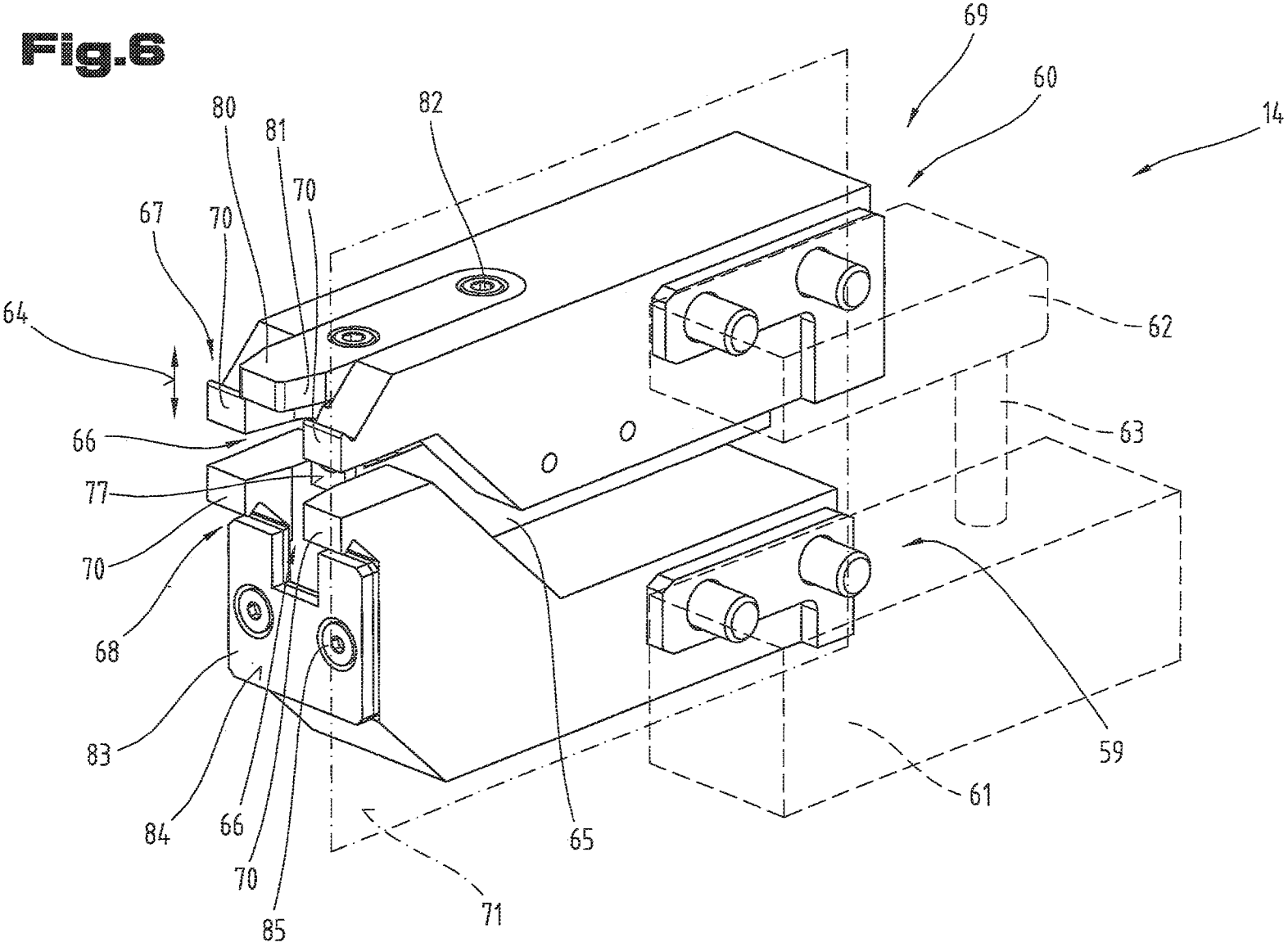
Figure 8:
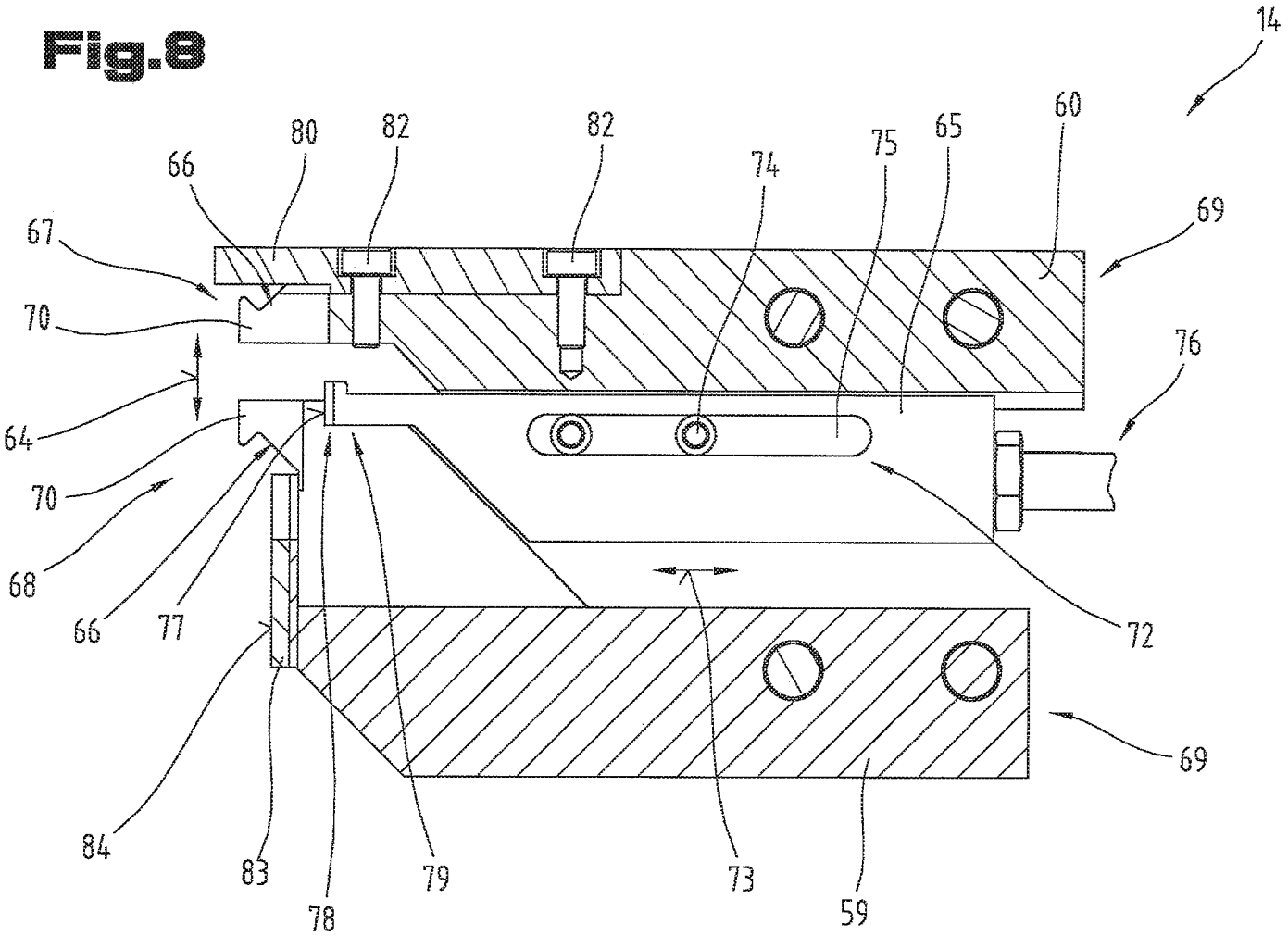
FIG. 8 A depiction of the gripping device in half-section.

FIGS. 6 to 8 depict an example embodiment of a gripping device 14 according to the invention in various views, with identical reference signs and component names being used for the same parts as in the preceding figures. To avoid unnecessary repetition, please refer to the detailed description in the above figures.

FIG. 6 shows a perspective view of the gripping device 14, which is formed to manipulate the bending tool 6, especially to insert the bending tool 6 into the tool receptacle 5 and to take the bending tool 6 out of the tool receptacle 5.

FIG. 7 also shows a perspective view of the gripping device 14, this being shown in half-section to give a view of the internal parts.

FIG. 8 shows a half-section of the gripping device 14.

The construction of the gripping device 14 is explained/illustrated by viewing together FIG. 6, FIG. 7, and FIG. 8.

As is visible from FIG. 6, the gripping device 14 has a first gripping arm 59 and a second gripping arm 60. The first gripping arm 59 is arranged at a first gripping arm receptacle 61 and the second gripping arm 60 is arranged at a second gripping arm receptacle 62. Here it can be specified that the second gripping arm receptacle 62 have a first actuator 63, making the second gripping arm 60 displaceable relative to the first gripping arm 59 in the clamping direction 64. In other words, the first actuator 63 can move the two gripping arms 59, 60 closer together or farther apart.

It is further specified that the gripping device 14 have an unlocking member 65 that is received between the two gripping arms 59, 60. It can be specified here that a recess 66 be formed at both the first gripping arm 59 and at the second gripping arm 60, with the unlocking member 65 being moveable in the free space created by the recess 66. The recess 66 can extend from a gripping section 67 or a front end portion 68 to a back gripping arm area 69.

In particular, it can be specified that the recess 66 in the gripping arms 59, 60 form two gripping fingers 70 at the gripping section 67. As is particularly visible in FIG. 8, the gripping fingers 70 have a forked shape such that they can engage in the first gripping groove 23 or in the second gripping groove 24 of the bending tool 6. Because the second gripping arm 60 is displaceable relative to the first gripping arm 59 in the clamping direction 64, the bending tool 6 can be gripped or let go again as desired. It can further be specified that the first gripping arm 59 and/or the second gripping arm 60 be formed largely symmetrically in reference to a center plane 71, with the two gripping fingers 70 of a gripping arm 59, 60 each being arranged the same distance from the center plane 71 and the recess 66 being arranged at the exact middle of the center plane 71.

It can further be specified that the unlocking member 65 be arranged on the second gripping arm 60 using a non-turning longitudinal guide 72 such that it can be displaced in the direction of movement 73 relative to the first gripping arm 59 and/or to the second gripping arm 60. The non-turning longitudinal guide 72 can be realized by means of two guide bolts 74 that extend crossways through the second gripping arm 60 and act together with a slot 75 in the unlocking member 65. It can additionally be specified that the gripping device 14 comprise a second actuator 76 by which the unlocking member 65 can be moved in the direction of movement 73 relative to the second gripping arm 60.

Both the first actuator 63 and the second actuator 76 can, for example, be realized in the form of a pneumatic or hydraulic cylinder. Alternately, it is for example also conceivable for an electric centering actuator or a linear motor to be used as actuator.

The unlocking member 65 is formed in order to be able to actuate the actuating element 19 of the bending tool 6 and so be able to displace the locking element 20 between its unlocked position 26 and its locked position 28. In this way, the bending tool 6 can be inserted into and removed from the tool receptacle 5.

The unlocking member 65 has a manipulation face 77 that can act together with the actuating face 33 of the actuating element 19 and thereby move it. During actuation, the manipulation face 77 acts as a pressure element on the actuating face 33. It can further be specified that the unlocking member 65 be arranged in a front end portion 78 in which the manipulation face 77 is also arranged, have a gripping catch 79 that can engage in the actuating recess 35 of the actuating element 19, and can therefore displace the actuating element 19 out of its base position 27 into its actuating position 25 through a pulling motion. It is preferable for the gripping catch 79 to be semi-circular so that the actuating recess 35, which is formed as a circular groove 36 on the rotationally symmetric second actuating component 38, can be gripped well by the gripping catch 79.

As is particularly well-visible in FIG. 6, it can further be specified that the second gripping arm 60, in particular the gripping section 67, have a centering protrusion 80 that can engage in the centering recess 57 of the bending tool 6. This allows the bending tool 6 to be positioned relative to the gripping device 14. It is preferable for the centering protrusion 80 to be formed such that it has a bevel 81 on both sides that corresponds to the broadening of the centering recess 57. It can further be specified that the centering protrusion 80 take the form of a flat bar with corresponding bevels and be affixed to the second gripping arm by a fastener 82.

It is further possible for the gripping device 14 to include a wear protection element 83 arranged in the front end portion 68 of the first gripping arm 59. The wear protection element 83 has a wearing face 84. It can further be specified that the wear protection element 83 be affixed to the first gripping arm 59 by a fastener 85.

FIGS. 9 to 16 depict the interaction of the invented bending tool 6 and the invented gripping device 14 in various views, with identical reference signs and component names being used for the same parts as in the preceding figures. To avoid unnecessary repetition, please refer to the detailed description in the above figures.

Figure 9:
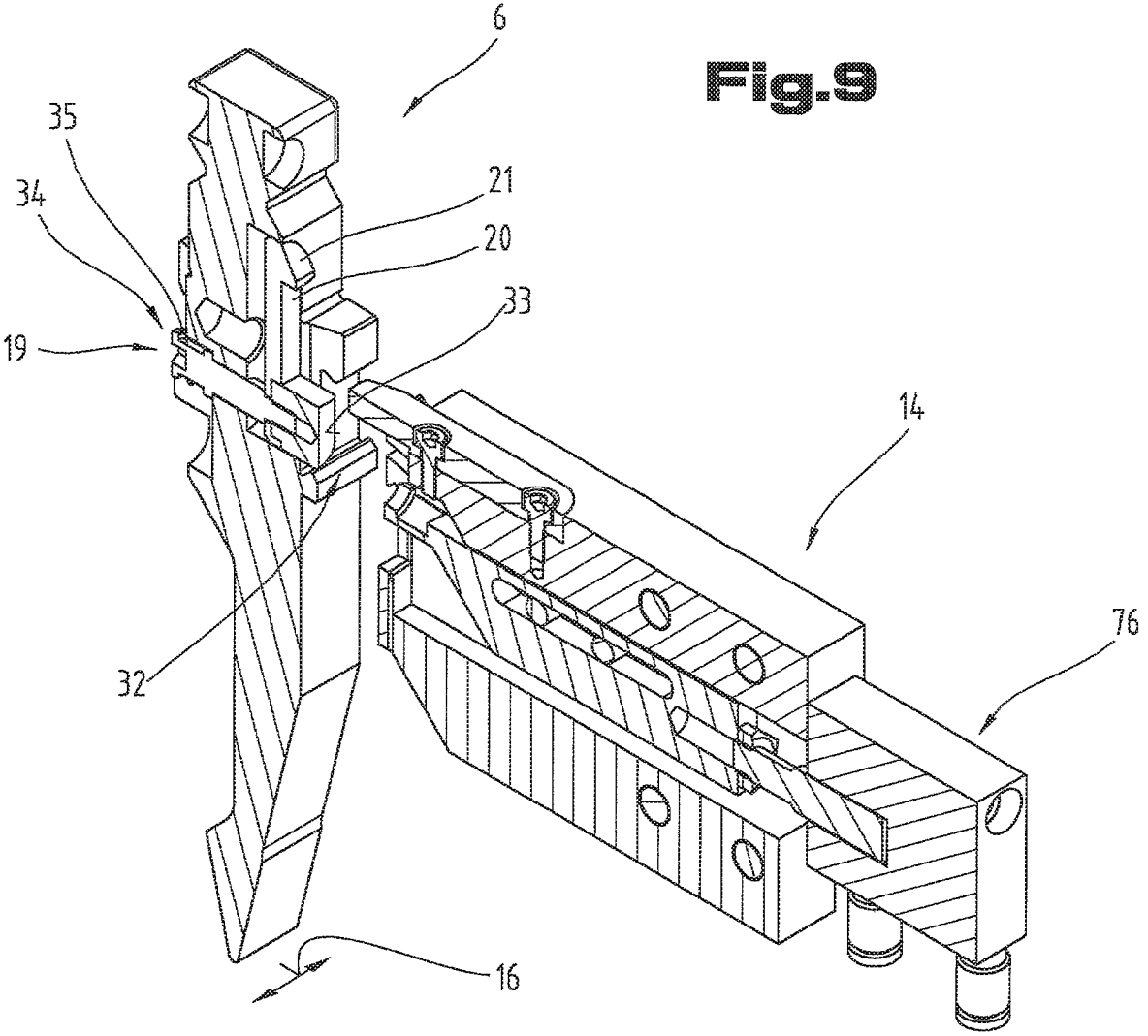
FIG. 9 A perspective view of the gripping device with bending tool in half-section.
Figure 10:
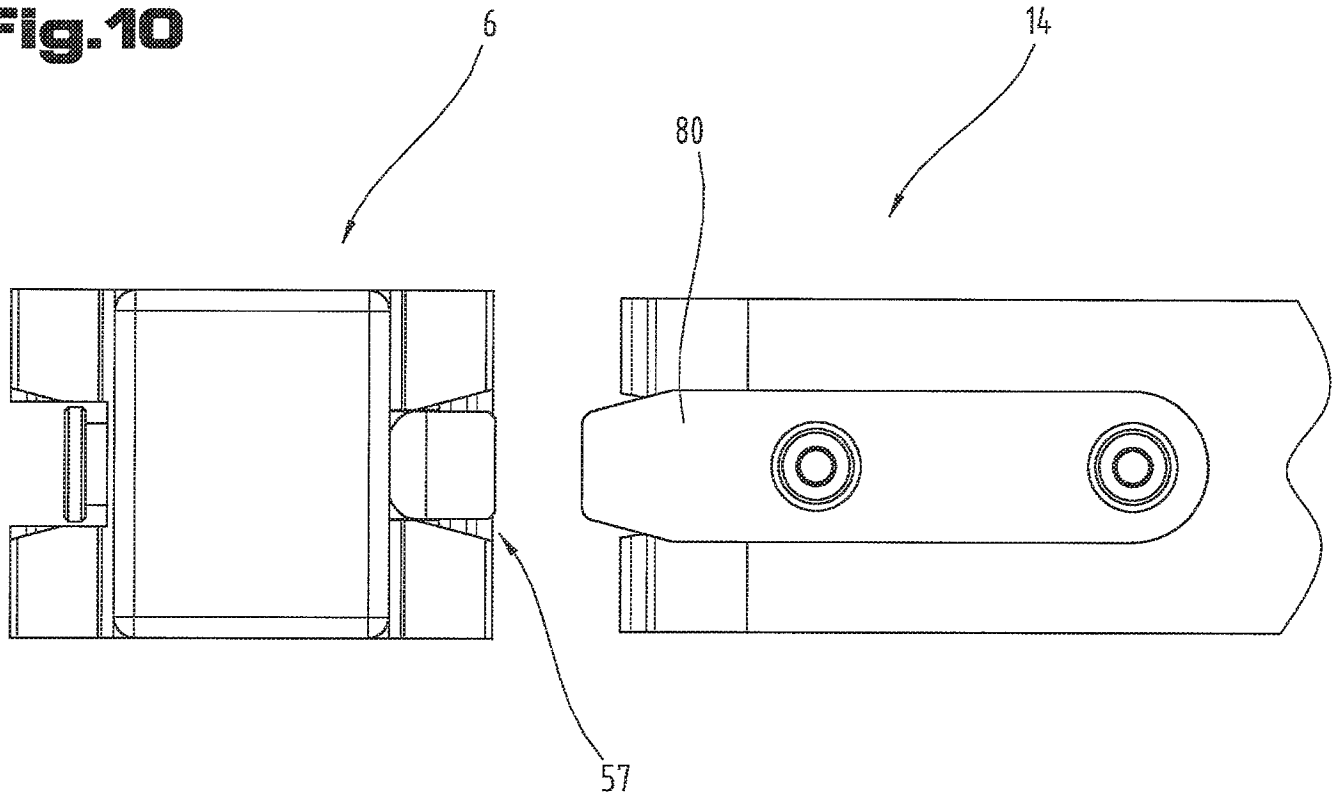
FIG. 10 A perspective view of the gripping device with bending tool in top view.

FIGS. 9 and 10 depict a perspective view in half-section or in top view of the interaction between the invented bending tool 6 and the invented gripping device 14. It is easily visible here that the centering protrusion 80 is formed so that it acts together with the centering recess 57, allowing the bending tool 6 to be positioned in the horizontal displacement direction 16 to the gripping device 14. It is further clearly visible from FIG. 8 that the centering recess 57 in the tool body 15 is arranged so that the actuating element 19 is freely accessible from above and from below and thus the unlocking member 65 can be freely moved in the centering recess 57.

The second actuator 76 for moving the unlocking member 65 is depicted schematically in FIG. 9.

Figure 11:
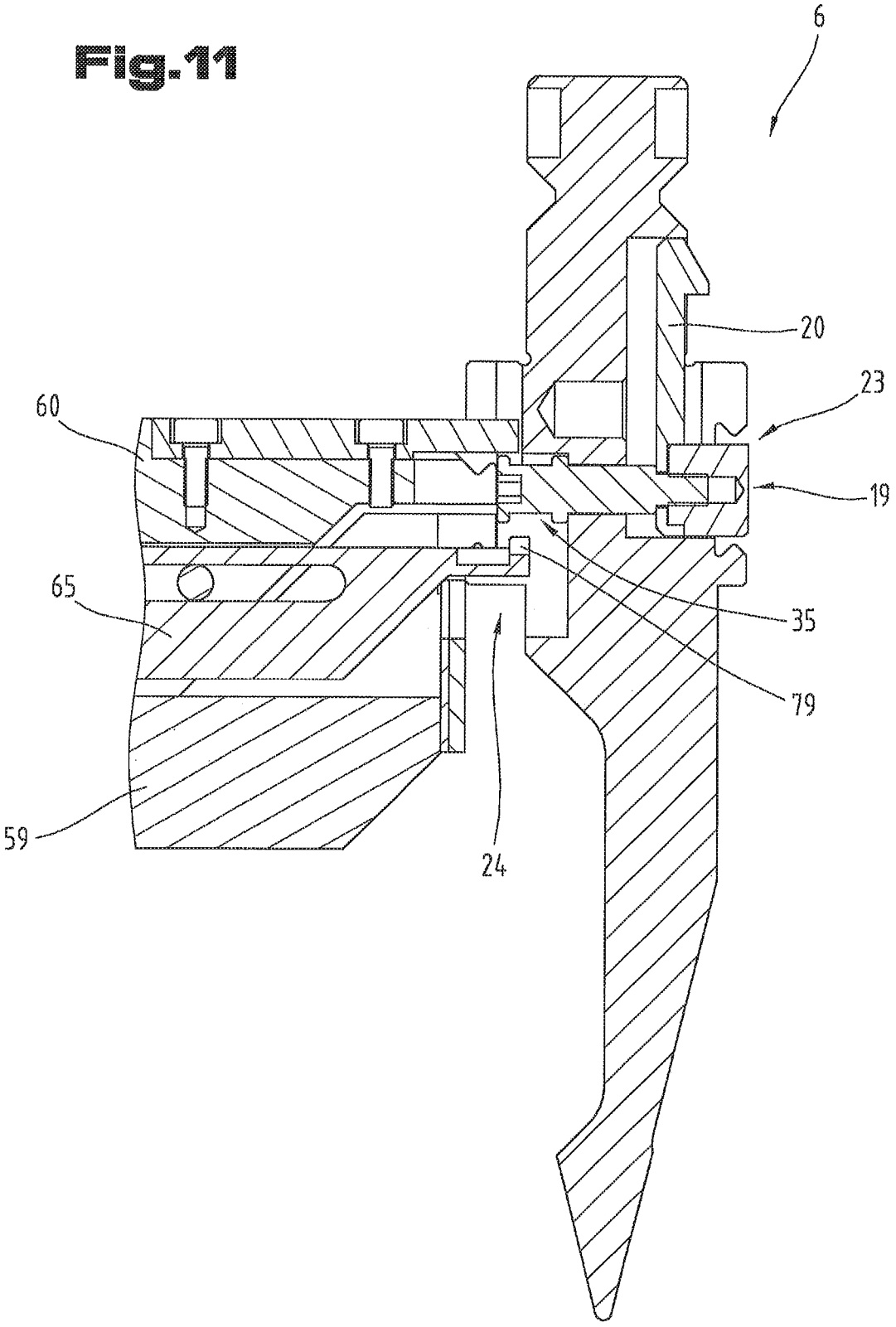
FIG. 11 A perspective view of the gripping device with bending tool in a cross-sectional view with the gripping device positioned at the second gripping groove in receiving step one.
Figure 12:
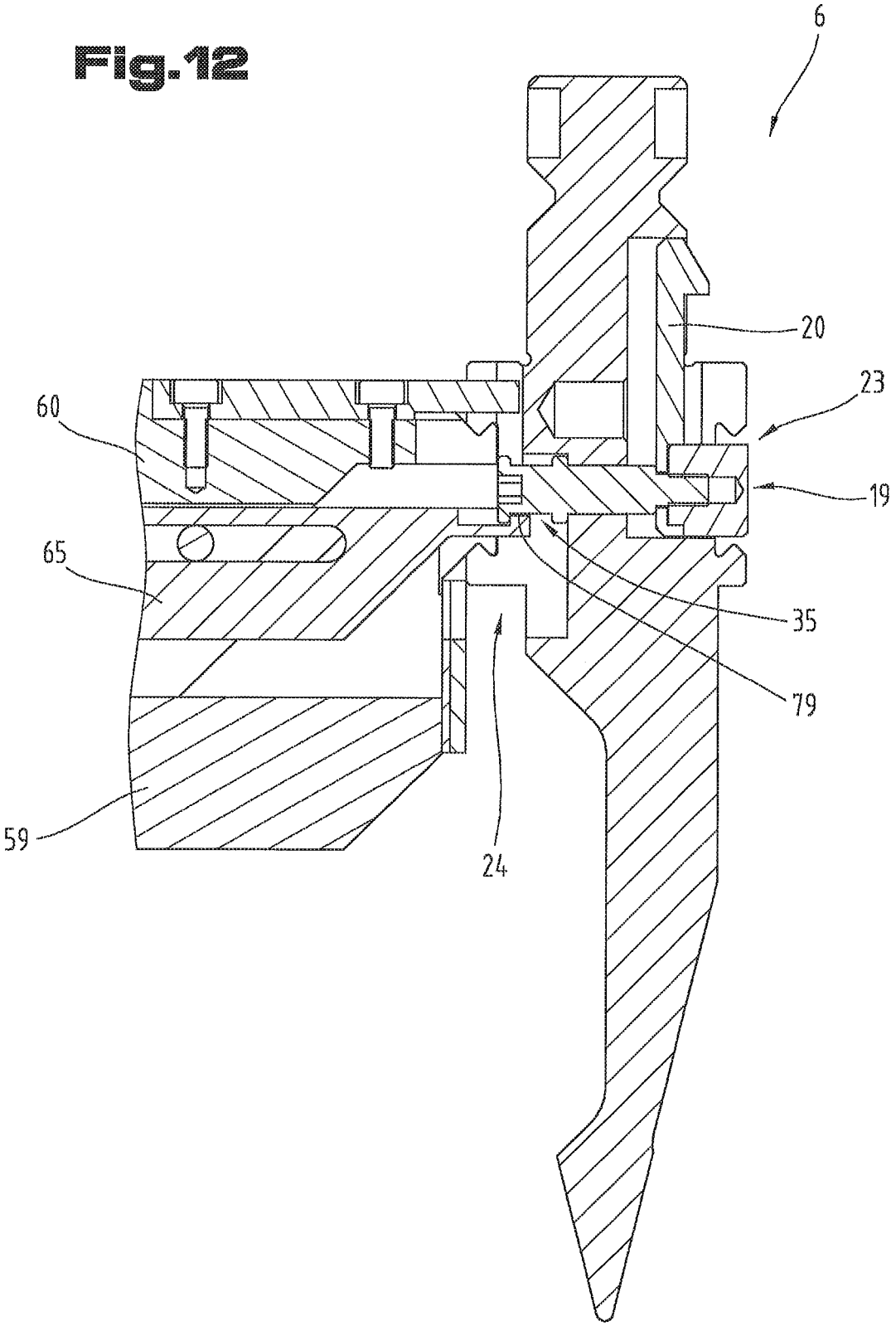
FIG. 12 A perspective view of the gripping device with bending tool in a cross-sectional view with the gripping device positioned at the second gripping groove in receiving step two.
Figure 13:
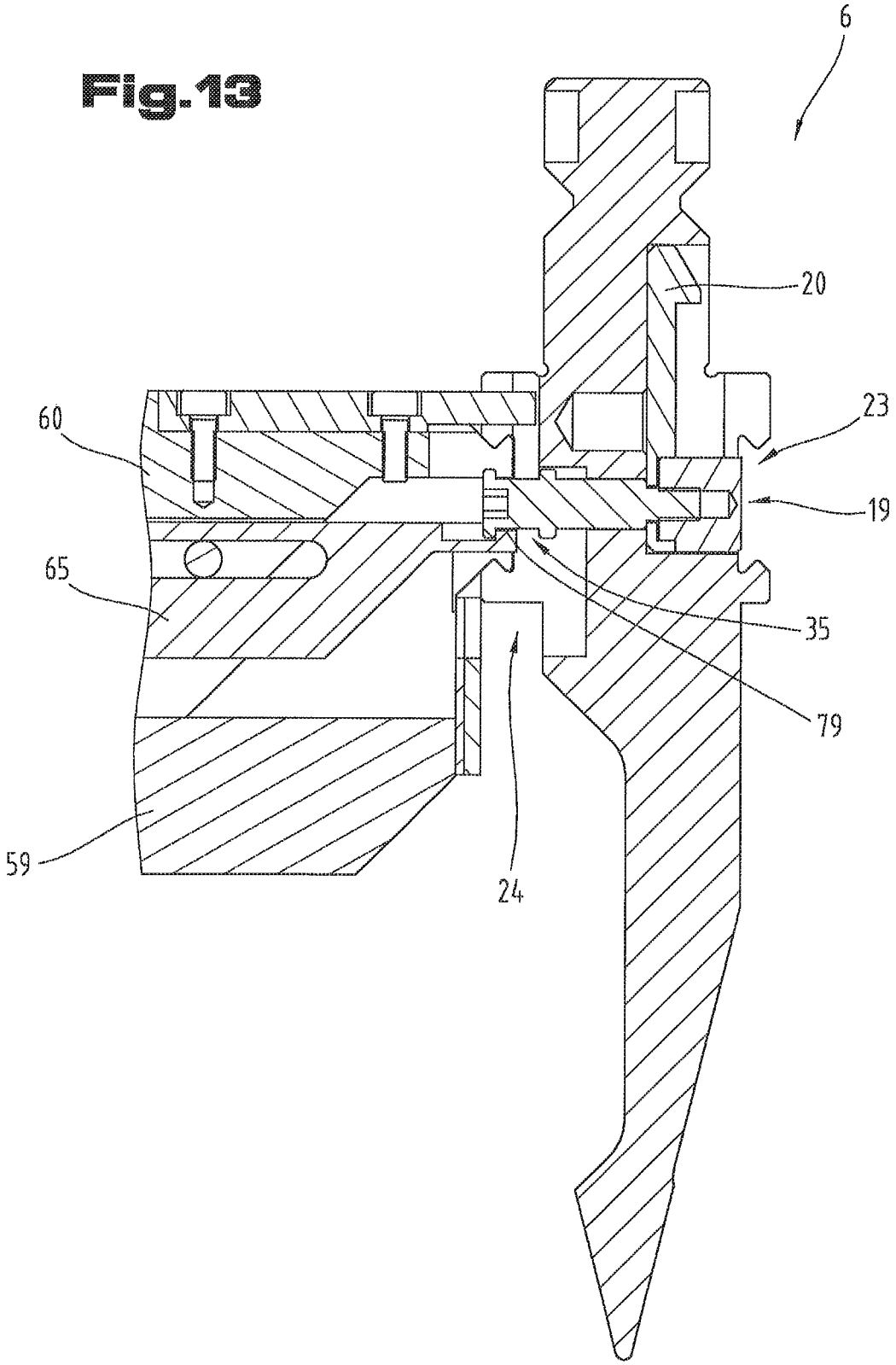
FIG. 13 A perspective view of the gripping device with bending tool in a cross-sectional view with the gripping device positioned at the second gripping groove in receiving step three.

FIG. 11 to 13 portray a side view of the process of the acceptance of the bending tool 6 by the gripping device 14 and of moving the locking element 20 out of its locked position 28 into the unlocked position 26 step-by-step and it will be explained step-by-step below.

In a first process step, the gripping device 14 is moved to the bending tool 6 such that the gripping fingers 70 of the first and/or second gripping arms 59, 60 are positioned within the second gripping groove 24. The gripping device 14 is thereby displaced downwards by the manipulating device 13 in a subsequent process step such that the gripping fingers 70 of the first gripping arm 59 engage with the second gripping groove 24 and touch each other.

Subsequently, in another process step depicted in FIG. 12, the second gripping arm 60 is moved upwards in the clamping direction 64 by the first actuator 63 and is thereby displaced relative to the first gripping arm 59 such that both the gripping fingers 70 of the first gripping arm 59 and the gripping fingers 70 of the second gripping arm 60 engage with the second gripping groove 24. At the same time, the unlocking member 65 affixed to the second gripping arm 60 is also displaced upwards such that the gripping catch 79 engages with the actuating recess 35.

In another process step as per FIG. 13, the unlocking member 65 can now be pulled away by the second actuator 76 in a direction away from the bending tool 6, displacing the actuating element 19 and, coupled to it, the locking element 20 from its locked position 28 to its unlocked position 26.

Now the bending tool 6 can be moved freely out of the tool receptacle 5 or inserted into it.

To take out the bending tool 6, the actuating element 19 can now in reverse order be brought back to its base position 27 and the gripping device 14 disengaged from the bending tool 6.

Figure 14:
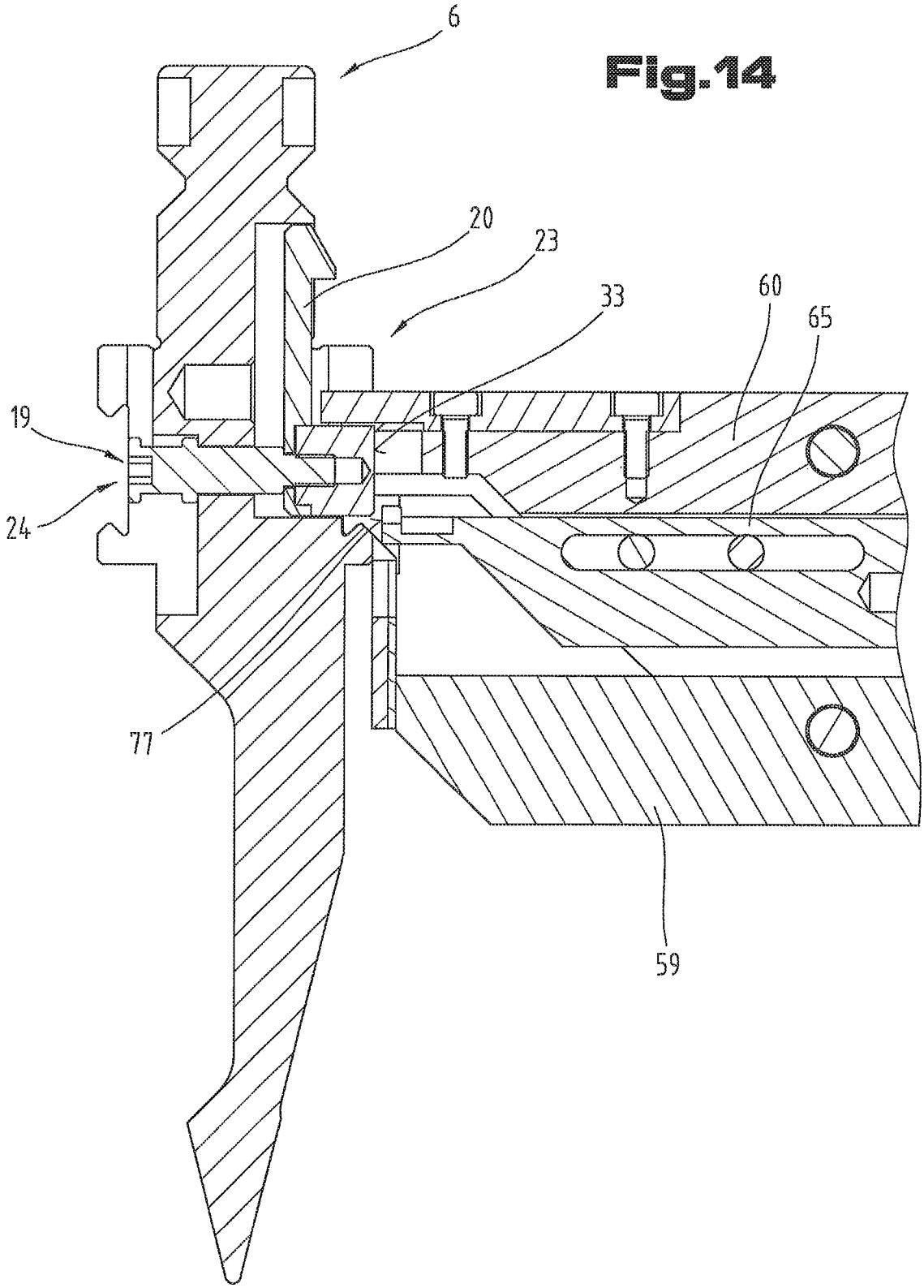
FIG. 14 A perspective view of the gripping device with bending tool in a cross-sectional view with the gripping device positioned at the first gripping groove in receiving step one.
Figure 15:
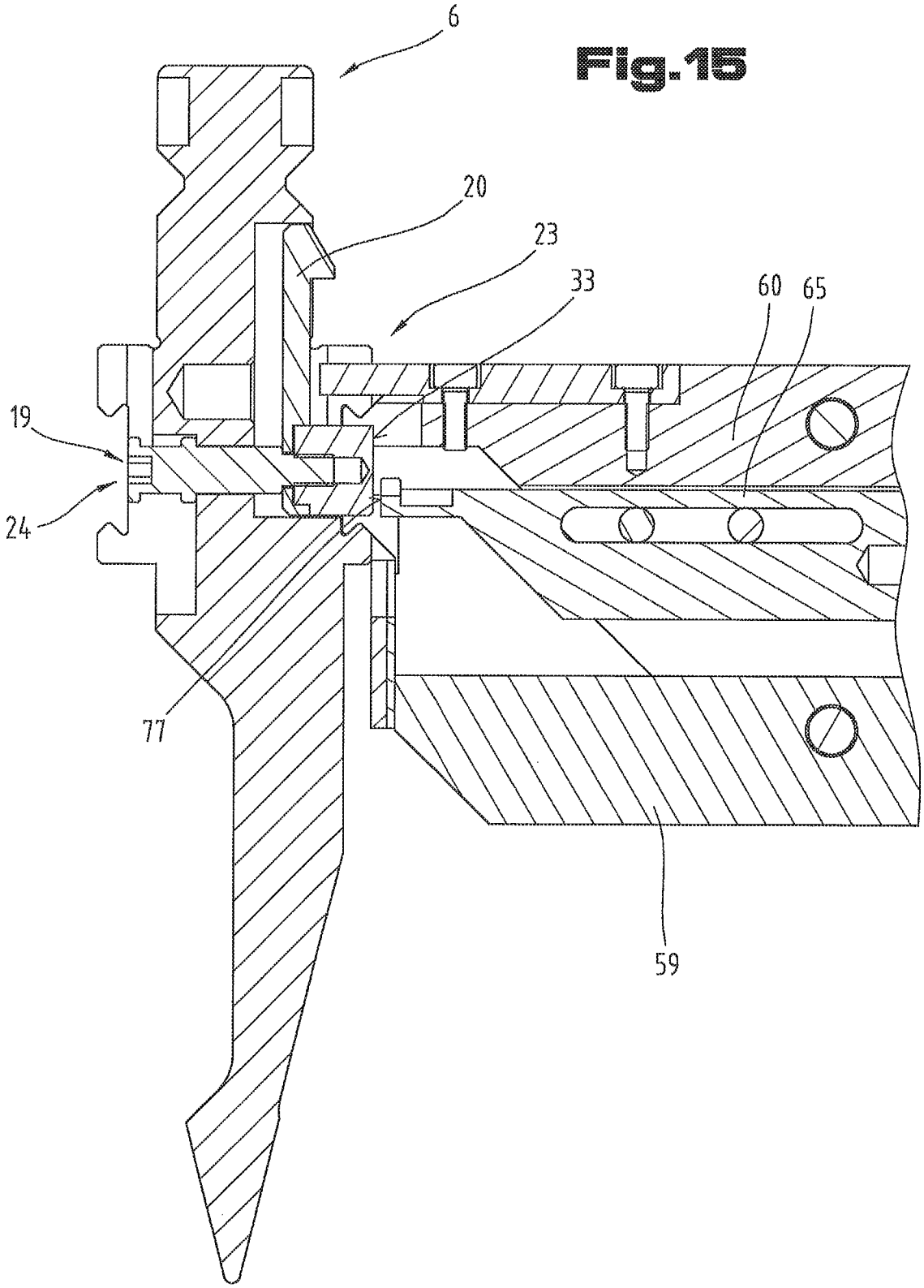
FIG. 15 A perspective view of the gripping device with bending tool in a cross-sectional view with the gripping device positioned at the first gripping groove in receiving step two.
Figure 16:
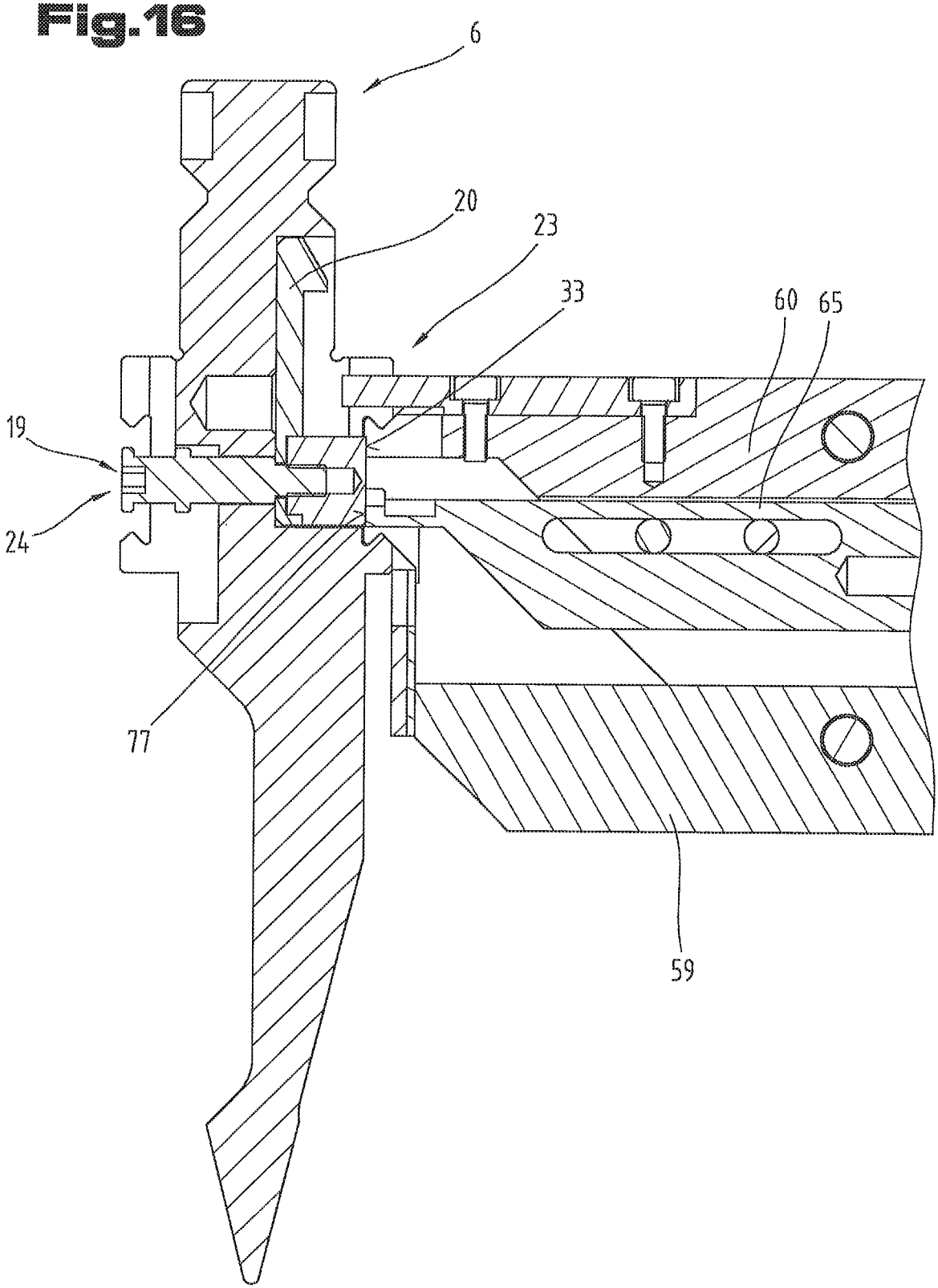
FIG. 16 A perspective view of the gripping device with bending tool in a cross-sectional view with the gripping device positioned at the first gripping groove in receiving step three.

FIG. 14 to 16 show another process for clamping and/or unlocking a bending tool 6, with the gripping device 14 here engaging in the first gripping groove 23 of the bending tool 6. In other words, it is described here how the bending tool 6 can be gripped from the opposite side.

In a first process step, the gripping device 14 is moved to the bending tool 6 such that the gripping fingers 70 of the first and/or second gripping arms 59, 60 are positioned within the first gripping groove 23. The gripping device 14 is thereby displaced downwards by the manipulating device 13 in a subsequent process step such that the gripping fingers 70 of the first gripping arm 59 engage with the first gripping groove 23 and touch each other.

Subsequently, in another process step depicted in FIG. 15, the second gripping arm 60 is moved upwards in the clamping direction 64 by the first actuator 63 and is thereby displaced relative to the first gripping arm 59 such that both the gripping fingers 70 of the first gripping arm 59 and the gripping fingers 70 of the second gripping arm 60 engage with the first gripping groove 23. At the same time, the unlocking member 65 affixed to the second gripping arm 60 is also displaced upwards such that the gripping catch 79 engages with the actuating recess 35.

In another process step as per FIG. 16, the unlocking member 65 can now be pushed by the second actuator 76 in a direction towards the bending tool 6, displacing the actuating element 19 and, coupled to it, the locking element 20 from its locked position 28 to its unlocked position 26.

Now the bending tool 6 can be moved freely out of the tool receptacle 5 or inserted into it.

To take out the bending tool 6, the actuating element 19 can now in reverse order be brought back to its base position 27 and the gripping device 14 disengaged from the bending tool 6.

The example embodiments show possible variations of the bending tool 6 and the gripping device 14; let it be noted at this juncture that the invention is not limited to the specially portrayed variations of embodiments themselves, but that diverse combinations of the individual variations of embodiments are possible and that this possibility of variation falls within the competence of a person active in this technical field based on the teaching regarding technical action provided by this invention.

Furthermore, individual characteristics or combinations of characteristics from the depicted and described various example embodiments can constitute independent inventive or invented solutions.

The aim underlying the independent invented solutions can be taken from the description.

All information regarding ranges of values in this description should be understood to mean that these include any and all partial ranges, e.g. the statement 1 to 10 should be understood to mean that all partial ranges starting from the lower threshold 1 and the upper threshold 10 are included, i.e. all partial ranges begin with a lower threshold of 1 or larger and with an upper threshold of 10 or less, e.g. 1 to 1.7 or 3.2 to 8.1 or 5.5 to 10.

Above all, the individual embodiments shown in FIGS. 1, 2 to 5, 6 to 8, and 9 to 16 can form the subject of independent invented solutions. The relevant aims according to the invention and solutions can be found in the detailed descriptions of these figures.

As a matter of form, let it be noted that, to facilitate a better understanding of the design of the bending tool 6 and the gripping device 14, these and their components have in places been portrayed not to scale and/or enlarged and/or scaled-down.

LIST OF REFERENCE SIGNS

1 Processing system
2 Bending press
3 Sheet metal
4 First pressing beam
5 Tool receptacle
6 Bending tool
7 Second pressing beam
8 Press drive unit
9 Computer unit
10 Input/display unit
11 Upper end position
12 Lower end position
13 Manipulating device
14 Gripping device
15 Tool body
16 Horizontal displacement direction
17 Vertical insertion direction
18 Bending edge
19 Actuating element
20 Locking element
21 Locking catch
22 Recess in tool receptacle

23 First gripping groove
24 Second gripping groove
25 Actuating position of actuating element
26 Unlocked position of locking element
27 Base position of actuating element
28 Locked position of locking element
29 Spring
30 Spring receptacle
31 Back side of locking element
32 First end portion of actuating element
33 Actuating face
34 Second end portion of actuating element
35 Actuating recess
36 Circular groove
37 First actuating component
38 Second actuating component
39 Screw section
40 Threaded hole
41 Projection
42 Locking element through-hole
43 Hexagon socket
44 Guide section
45 Tool body through-hole
46 Guide section external diameter
47 Screw section external diameter
48 Ring projection
49 Locking element receptacle
50 Bottom surface of locking element receptacle
51 Actuating element receptacle
52 Bottom surface of actuating element receptacle
53 Clamp recess
54 Clamping jaws
55 Bevel
56 Receptacle section
57 Centering recess
58 Axis of symmetry
59 First gripping arm
60 Second gripping arm
61 First gripping arm receptacle
62 Second gripping arm receptacle
63 First actuator
64 Clamping direction
65 Unlocking member
66 Gripping arm recess
67 Gripping section
68 Front end portion of gripping arm
69 Back gripping arm area
70 Gripping finger
71 Center plane
72 Non-turning longitudinal guide
73 Direction of movement
74 Guide bolt
75 Slotted hole
76 Second actuator
77 Manipulation face
78 Front end portion of unlocking member
79 Gripping catch
80 Centering protrusion
81 Bevel
82 Fastener
83 Wear protection element
84 Wearing face
85 Fastener

The invention claimed is:

1. Bending tool for insertion in a tool receptacle, the bending tool comprising:

a tool body comprising a first gripping groove and a second gripping groove arranged opposite to each other, a locking element comprising a locking catch, the locking element being disposed in and/or on the tool body, and an actuating element coupled to the locking element, the actuating element being movable between a base position and an actuating position, the base position corresponding to a locked position of the locking element, the actuating position corresponding to an unlocked position of the locking element, the actuating element having a first end portion and a second end portion, the first end portion having an actuating face, the second end portion having an actuating recess, wherein the first end portion of the actuating element is accessible in a region of the first gripping groove and the second end portion of the actuating element is accessible in a region of the second gripping groove, wherein the actuating recess is configured such that a gripping catch of a gripping device for manipulating the bending tool can engage in the actuating recess of the actuating element to pull the actuating element out of the base position into the actuating position, and wherein the first end portion of the actuating element is rigidly connected to the second end portion of the actuating element, such that when the gripping catch of the gripping device engages in the actuating recess and pulls the actuating element, the actuating face and the actuating element are moved out of the base position into the actuating position.

2. Bending tool as in claim 1, wherein the actuating element is rotationally symmetric in a region of the second end portion, with the actuating recess configured as a circular groove.

3. Bending tool as in claim 1, wherein the actuating element comprises a first actuating component and a second actuating component, wherein the first end portion of the actuating element is arranged at the first actuating component, wherein the second end portion of the actuating element is arranged at the second actuating component, and wherein the first actuating component and the second actuating component are joined together such that the locking element is clamped between the first actuating component and the second actuating component.

4. Bending tool as in claim 3, wherein the second actuating component has a screw section that is screwed into a threaded hole in the first actuating component, with the screw section then having a projection for clamping the locking element.

5. Bending tool as in claim 3, wherein the second actuating component has a guide section that is rotationally symmetric and said guide section is received in a through-hole in the tool body.

6. Bending tool as in claim 5, wherein the second actuating component has a screw section that is screwed into a threaded hole in the first actuating component, with the screw section then having a projection for clamping the locking element, and wherein the guide section is connected to the screw section, with an external diameter of the guide section being larger than an external diameter of the screw section and with a circular ring projection being connected to the guide section.

7. Bending tool as in claim 1, wherein the first gripping groove and the second gripping groove have a dovetail shape and are arranged parallel to each other.

8. Bending tool as in claim 1, wherein the tool body comprises a centering recess that widens, the centering recess being in a middle of the first and the second gripping groove.

9. Bending tool as in claim 1, further comprising a compression spring arranged in a spring receptacle in the tool body, wherein the compression spring acts on a back of the locking element.

10. A system comprising:

a bending tool for insertion in a tool receptacle, the bending tool comprising:

a tool body comprising a first gripping groove and a second gripping groove arranged opposite to each other, a locking element comprising a locking catch, the locking element being disposed in and/or on the tool body, and an actuating element coupled to the locking element, the actuating element being movable between a base position and an actuating position, the base position corresponding to a locked position of the locking element, the actuating position corresponding to an unlocked position of the locking element, the actuating element having a first end portion and a second end portion, the first end portion having an actuating face, the second end portion having an actuating recess, and a gripping device for manipulating the bending tool, the gripping device comprising:

a first gripping arm and a second gripping arm that is displaceable relative to the first gripping arm in a clamping direction, the first and second gripping arms being configured to engage in the first gripping groove or the second gripping groove, respectively, in the tool body of the bending tool and to clamp the bending tool, an unlocking member for actuating the actuating element of the bending tool, the unlocking member being longitudinally displaceable normally to the clamping direction relative to the first and second gripping arms, and a gripping catch arranged on the unlocking member, wherein the first end portion of the actuating element is accessible in a region of the first gripping groove and the second end portion of the actuating element is accessible in a region of the second gripping groove, wherein the actuating recess is configured such that the gripping catch of the gripping device for manipulating the bending tool can engage in the actuating recess of the actuating element to pull the actuating element out of the base position into the actuating position, and wherein the first end portion of the actuating element is rigidly connected to the second end portion of the actuating element, such that when the gripping catch of the gripping device engages in the actuating recess and pulls the actuating element, the actuating face and the actuating element are moved out of the base position into the actuating position.

11. The system as in claim 10, wherein the unlocking member is mounted on the second gripping arm by a non-turning longitudinal guide, through which the unlocking member is positioned longitudinally displaceably on the second gripping arm.

12. The system as in claim 10, wherein the first gripping arm and the second gripping arm each have a respective recess in a center of a gripping section, with two gripping fingers arranged on the first gripping arm and the second gripping arm through the respective recess, with the unlocking member being moveable in a free space within the recesses.

13. The system as in claim 10, further comprising a centering protrusion arranged in the gripping section of the first gripping arm that acts together with a centering recess of the bending tool and wherein the tool body of the bending tool comprises the centering recess that widens, the centering recess being in a middle of the first and the second gripping groove.

14. The system as in claim 10, wherein a front end portion of the first gripping arm has a wear protection element, with a wearing face of the wear protection element oriented parallel to the clamping direction.

15. The system as in claim 10, wherein the second gripping arm is displaceable relative to the first gripping arm by a first actuator.

16. The system as in claim 15, wherein the unlocking member is longitudinally displaceable by a second actuator.

17. The system as in claim 10, further comprising a manipulation face arranged on the unlocking member for displacing the actuating face of the actuating element of the bending tool.

18. Bending tool for insertion in a tool receptacle, the bending tool comprising:

a tool body comprising a first gripping groove and a second gripping groove arranged opposite to each other, a locking element comprising a locking catch, the locking element being disposed in and/or on the tool body, and an actuating element coupled to the locking element, the actuating element being movable between a base position and an actuating position, the base position corresponding to a locked position of the locking element, the actuating position corresponding to an unlocked position of the locking element, the actuating element having a first end portion and a second end portion, the first end portion having an actuating face, the second end portion having an actuating recess, wherein the first end portion of the actuating element is accessible in a region of the first gripping groove and the second end portion of the actuating element is accessible in a region of the second gripping groove, wherein the actuating recess is accessible from outside such that a gripping catch of a gripping device for manipulating the bending tool can engage in the actuating recess of the actuating element to pull the actuating element out of the base position into the actuating position, and wherein the first end portion of the actuating element is rigidly connected to the second end portion of the actuating element, such that when the gripping catch of the gripping device engages in the actuating recess and pulls the actuating element, the actuating face and the actuating element are moved out of the base position into the actuating position.

* * * * *